US007572759B2

(12) United States Patent
Fine et al.

(10) Patent No.: US 7,572,759 B2
(45) **Date of Patent: *Aug. 11, 2009**

(54) HETEROGENEOUS CLEANING COMPOSITION

(75) Inventors: David A. Fine, Minneapolis, MN (US); Terry J. Klos, Victoria, MN (US); Gretchen L. King, Rosemount, MN (US); Richard D. Stardig, Golden Valley, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/141,683

(22) Filed: Jun. 18, 2008

(65) Prior Publication Data

US 2008/0255021 A1 Oct. 16, 2008

Related U.S. Application Data

(63) Continuation of application No. 11/622,894, filed on Jan. 12, 2007, now Pat. No. 7,399,316, which is a continuation of application No. 10/435,342, filed on May 9, 2003, now Pat. No. 7,179,781.

(60) Provisional application No. 60/467,662, filed on May 2, 2003.

(51) Int. Cl.
*C11D 3/60* (2006.01)
*C11D 3/386* (2006.01)
*C11D 17/00* (2006.01)

(52) U.S. Cl. ..... 510/438; 510/276; 510/320; 510/327; 510/392; 510/407; 510/439

(58) Field of Classification Search ..... 510/438, 510/276, 320, 327, 392, 407, 439
See application file for complete search history.

(56) References Cited

U.S. PATENT DOCUMENTS

| | | | | |
|---|---|---|---|---|
| 5,670,473 | A | 9/1997 | Scepanski | |
| 5,688,046 | A | 11/1997 | Triassi et al. | |
| 5,739,095 | A | 4/1998 | Langguth et al. | |
| 5,747,440 | A * | 5/1998 | Kellett et al. | 510/276 |
| 5,830,839 | A | 11/1998 | Scepanski | |
| 5,858,117 | A | 1/1999 | Oakes et al. | |
| 5,858,299 | A | 1/1999 | Fernholz et al. | |
| 5,929,011 | A | 7/1999 | Scepanski | |
| 5,932,531 | A | 8/1999 | Oberlander et al. | |
| 5,981,463 | A | 11/1999 | Oberlander et al. | |
| 6,110,886 | A | 8/2000 | Scepanski | |
| 6,150,316 | A | 11/2000 | Scepanski | |
| 6,395,702 | B2 | 5/2002 | Scepanski | |
| 6,395,703 | B2 | 5/2002 | Scepanski | |
| 6,624,130 | B2 | 9/2003 | Giblin et al. | |
| 6,878,679 | B2 | 4/2005 | Sommerville-Roberts et al. | |
| 7,179,781 | B2 * | 2/2007 | Fine et al. | 510/438 |
| 2005/0261155 | A1 | 11/2005 | Wiedemann et al. | |

FOREIGN PATENT DOCUMENTS

| | | |
|---|---|---|
| EP | 413616 | 4/1990 |
| EP | 0413616 A1 * | 2/1991 |
| GB | 1323670 | 7/1973 |
| GB | 1397245 | 6/1975 |
| WO | WO02/36727 | 5/2002 |

* cited by examiner

*Primary Examiner*—Lorna M Douyon
(74) *Attorney, Agent, or Firm*—Andrew D. Sorensen; Anneliese S. Mayer

(57) ABSTRACT

A heterogenous cleaning composition comprises more than 75 wt % active ingredients, the active ingredients comprising at least about 20 wt % surfactant and at least about 20 wt % sequestrant, wherein the composition comprises at least one liquid and at least one powder.

15 Claims, No Drawings

HETEROGENEOUS CLEANING COMPOSITION

CROSS REFERENCE TO RELATED APPLICATION

This application is a continuation of U.S. patent application Ser. No. 11/622,894, filed on Jan. 12, 2007, now U.S. Pat. No. 7,399,316, which is a continuation of U.S. patent application Ser. No. 10/435,342, filed on May 9, 2003, now U.S. Pat. No. 7,179,781, which claims priority under 35 U.S.C. § 119(e) to U.S. Provisional Application entitled "HETEROGENEOUS CLEANING COMPOSITION AND METHODS", Ser. No. 60/467,662, filed on May 2, 2003, the entire disclosure of all of which are incorporated herein by reference in their entirety.

This application is also related to U.S. Pat. Nos. 7,303,587 and 7,169,192, the entire disclosure of all of which are incorporated herein by reference in their entirety.

FIELD OF THE INVENTION

The present invention relates to heterogeneous cleaning compositions, methods employing them, and methods of making them.

BACKGROUND OF THE INVENTION

Existing methods and apparatus can adequately dispense homogeneous compositions, such as homogeneous cleaning compositions. Even with existing technology, dispensing liquids or powders can be messy, exposing persons to the neat or concentrated composition. Dispensing solids can be difficult and expensive. Improved methods and apparatus are needed to dispense heterogeneous compositions, particularly heterogeneous compositions including at least one component that flows.

Existing cleaning compositions require formulations that keep the composition homogeneous and/or stable. Homogeneous liquid and solid compositions include a significant amount of materials that keep them homogeneous and stable. There remains a need for a product that can be employed in a heterogeneous form, that can include an increased proportion of active ingredients (rather than ingredients that keep the composition homogeneous and stable), and that can form a homogeneous concentrate and/or use composition.

SUMMARY OF THE INVENTION

The present invention relates to heterogeneous cleaning compositions that form homogeneous intermediate and/or use compositions, methods employing them, and methods of making them.

The present heterogeneous cleaning compositions include a heterogeneous mixture of active ingredients. Typically the active ingredients make up more than 75 wt-% of the heterogeneous composition, and they can make up as much as 99 wt-% or 100 wt-% of the composition. The active ingredients in the heterogeneous cleaning composition can include active cleaning ingredients and active conditioning ingredients. In an embodiment, the heterogeneous cleaning composition includes a heterogeneous mixture of surfactant and sequestrant, such as for example a mixture including at least about 25 wt-% surfactant and at least about 30 wt-% sequestrant. The heterogeneous cleaning composition can also include active enzyme composition, source of alkalinity, antiredeposition agent, and/or optical brightener. The heterogeneous cleaning composition can be packaged for the end user.

DETAILED DESCRIPTION OF THE INVENTION

Definitions

As used herein, the term "heterogeneous" refers to a cleaning composition that is not uniform in its macroscopic properties (non-isotropic). For example, a heterogeneous cleaning composition can include mixed ingredients or dissimilar or diverse ingredients or constituents. The present heterogeneous cleaning composition includes two or more substances that need not be evenly dispersed.

As used herein, the phrase "active ingredient" refers to an ingredient of the present heterogeneous cleaning composition that contributes to the performance (e.g., soil removal, fabric conditioning, optical brightening, softening, sanitizing, stain repellency, color protection, dye-transfer inhibition, deodorizing, starching, de-watering, rinsing, anti-wrinkling and/or bleaching performance) of a use composition of the present heterogeneous composition. Active ingredients include active soil removal ingredients, active fabric conditioning ingredients, active water conditioning ingredients, active bleaching ingredients, and the like. Active ingredient does not include an ingredient present exclusively to make a cleaning composition homogeneous or to keep the cleaning composition in a particular physical form, such as powder, solid, liquid, or the like. For example, the following are not active ingredients: water, hydrotrope, solvent, dispersant, thickener, viscosity modifier, deflocculating agent, electrolyte, binding agent, solidifying agent, processing aid, flow aid, emulsifier, and anticaking agent.

As used herein, the phrase "active soil removal ingredient" refers to an ingredient of the present heterogeneous cleaning compositions that contributes to cleaning by a use composition of the present heterogeneous composition. Examples of active cleaning ingredients include surfactant, sequestrant, source of alkalinity, detersive enzyme, active enzyme composition, antiredeposition agent, penetrant, organic solvent cleaning agent, and the like.

As used herein, the phrase "active fabric conditioning ingredient" refers to an ingredient of the present heterogeneous cleaning compositions that contributes to conditioning of, for example, a textile by a use composition of the present heterogeneous composition. Examples of active fabric conditioning ingredients include softener, wetting agents, starch, soil repellent, soil release agents, anti-wrinkle agent, antistatic agent, color protection agent (e.g., dye transfer inhibitor), and the like.

As used herein, the phrase "active water conditioning ingredient" refers to an ingredient of the present heterogeneous cleaning compositions that contributes to minimizing the deleterious effects of hardness ions (e.g. calcium, magnesium) in the wash water by a use composition of the present heterogeneous composition. Examples of active water conditioning ingredients include sequestrants, chelants, ion exchange agents, precipitants, threshold agents, and the like.

As used herein, the phrase "active bleaching ingredient" refers to an ingredient of the present heterogeneous cleaning compositions that contributes to the lightening of a colored substrate by chemical reaction by a use composition of the present heterogeneous composition. Examples of active bleaching ingredients include oxidizing agents and reducing agents.

As used herein, the phrase "active fluorescent whitening ingredient" refers to an ingredient of the present heterogeneous cleaning compositions that contributes to the whitening of a textile by fluorescence by a use composition of the present heterogeneous composition. Examples of active whitening ingredients include optical brighteners.

As used herein, the phrase "effective homogenizing amount" refers to an amount of an agent such as a hydrotrope or organic solvent effective to render a mixture or a composition homogeneous.

As used herein, the phrase "effective detersive enzyme stabilizing amount" refers to an amount of an agent such as a polyol effective to maintain a detersive enzyme in a stable form that exhibits detersive enzyme activity in a use composition of the heterogeneous composition. An effective detersive enzyme stabilizing amount is ineffective to render the heterogeneous composition homogeneous.

As used herein, the phrase "effective cleaning amount" of an organic solvent refers to an amount of organic solvent effective for soil (e.g., oily soil) removal in a use composition of the heterogeneous composition. An effective cleaning amount of an organic solvent is ineffective to render the heterogeneous composition homogeneous.

As used herein, the phrase "consisting essentially of" refers to a heterogeneous composition including the listed ingredients and/or amounts of listed ingredients. A heterogeneous composition that consists essentially of listed ingredients does not include additional ingredients that, if present, would render the heterogeneous composition homogeneous. A heterogeneous composition that consists essentially of listed ingredients does not include any of the listed ingredients at a level high enough to render the heterogeneous composition homogeneous. For example, a heterogeneous composition that consists essentially of listed ingredients does not include added water (other than water of hydration of a listed ingredient), dispersant, thickener, binding agent, processing aid, flow aid, emulsifier, or anticaking agent.

As used herein, the term "about" modifying the quantity of an ingredient in the compositions of the invention or employed in the methods of the invention refers to variation in the numerical quantity that can occur, for example, through typical measuring and liquid handling procedures used for making cleaning compositions, concentrates, or use compositions in the real world; through inadvertent error in these procedures; through differences in the manufacture, source, or purity of the ingredients employed to make the compositions or carry out the methods; and the like. Whether or not modified by the term "about", it is intended that the claims include equivalents to the quantities.

Compositions

The present invention includes heterogeneous cleaning compositions and methods employing them.

In an embodiment, the present compositions include about 75 wt-% or more, about 80 wt-% or more, about 85 wt-% or more, about 90 wt-% or more, about 95 wt-% or more, about 96 wt-% or more, about 97 wt-% or more, about 98 wt-% or more, about 99 wt-% or more, about 99.5 wt-% or more, or 100 wt-% active ingredients. A product that includes 100 wt-% active ingredients does not include, for example, water (other than water of hydration of the listed ingredients), dispersant, thickener, binding agent, processing aid, flow aid, emulsifier, anticaking agent. The composition can include any of these ranges or amounts not modified by about.

The active ingredients can include active cleaning ingredients, active fabric conditioning ingredients, active water conditioning ingredients, active bleaching ingredients, active fluorescent whitening ingredients, and the like. In an embodiment, active ingredients include active cleaning ingredients and active conditioning ingredients. The active cleaning ingredient can include surfactant, sequestrant, source of alkalinity, bleach (preferably non-chlorine), detersive enzyme, active enzyme composition, antiredeposition agent, organic solvent cleaning agent, or the like. In an embodiment, active cleaning ingredients include sequestrant, source of alkalinity, active enzyme composition, and antiredeposition agent. The active fabric conditioning ingredient can include softener, starch, soil repellent, optical brightener, antiwrinkle agent, optical brightener, color protection agent (e.g., dye transfer inhibitor), and the like.

In an embodiment, the present heterogeneous composition includes surfactant, sequestrant, and active enzyme composition. This embodiment can also include source of alkalinity, antiredeposition agent, and/or optical brightener. The heterogeneous composition can include about 25 wt-% or more, about 30 wt-% or more, or about 30 wt-% surfactant and also about 30 wt-% or more, about 35 wt-% or more, or about 30 (e.g., 34) wt-% sequestrant. In an embodiment, the present composition includes about 25 to about 40 wt-% surfactant (e.g., nonionic surfactant) and about 30 to about 45 wt-% sequestrant (e.g., sodium tripolyphosphate). This composition can also include about 15 to about 25 wt-% source of alkalinity (e.g., sodium carbonate or light density soda ash), about 10 to about 25 wt-% active enzyme composition (e.g., protease plus enzyme activity agents), about 0.5 to about 2 wt-% antiredeposition agent (e.g., carboxymethylcellulose), about 0.05 to about 0.5 wt-% optical brightener (e.g., stilbene derivative). The composition can include any of these ranges or amounts not modified by about.

The present heterogeneous composition can be formulated to have one or more of a variety of characteristics. For example, the present heterogeneous composition can be non-corrosive, of low or mild alkalinity, or the like. A non-corrosive composition does not have a negative impact (e.g. burning) on human skin, as it pertains to U.S. Department of Transportation hazardous materials regulations. A composition of low or mild alkalinity does not contain high concentrations of strong bases, e.g. alkali metal hydroxides.

The present heterogeneous cleaning composition can take any of a variety of heterogeneous forms. For example, the present composition can be in the form of a slurry, in an embodiment a nonaqueous slurry. In an embodiment, the present composition can be in the form of a paste, powder, multi-phase liquid, gel, or the like.

In an embodiment, the present composition is nonaqueous, it contains no added water beyond any trace or incidental amounts present in the active ingredients, such as water of hydration that is part of an active ingredient. The present composition can be a nonaqueous slurry.

In an embodiment, the present heterogeneous cleaning composition includes all of the active ingredients required for use. That is, only a use composition from the present heterogeneous composition need be added to a washing machine to accomplish, for example, effective laundering. Further, such a one shot composition does not require addition of any composition other than water to form the intermediate composition used to form a use composition.

In an embodiment, even after aging, the present heterogeneous compositions at least partially leave (e.g., pour or flow from) an opened and inverted container under the force of gravity. Such compositions can include liquid, gel or semi-solid, or flowable solids. The present composition can also include components that are, for example, gelled or semi-solid, and that, under the influence of gravity, remain in the container for a prolonged time. In an embodiment, such components can be rinsed from the container in less than a predetermined time, such as less than about 20 min. In an embodiment, the present composition rinses readily from its container. That is, the present composition can be rinsed from the container in less than 15 minutes (e.g. about 1, 2, 5, 8, 10, 12, or 15 minutes (or such a time not modified by about)), with less than about 15 container volumes (e.g. about 5, 6, 7, 8, 9, 10, 11, 12, 13, 14, or 15 volumes (or such a quantity not modified by about)) of water.

In an embodiment, the heterogeneous compositions do not include or include only inconsequential (ineffective) amounts of, emulsifier, water, dispersant, thickener, binding agent, flow aid, anticaking agent, hydrotrope, or combinations or mixtures thereof. By inconsequential or ineffective amount is meant less than about 1 wt-% emulsifier, less than about 10 wt-% water, less than about 0.5 wt-% dispersant, less than about 0.5 wt-% thickener, less than about 2 wt-% binding agent, less than about 1 wt-% flow aid, less than about 2 wt-% anticaking agent, or less than about 5 wt-% hydrotrope. The composition can be described with respect to any of these ranges or amounts not modified by about.

The present heterogeneous cleaning compositions can be diluted (e.g., with mixing) to form homogeneous intermediate compositions. Typically, the present intermediate composition includes that components of the heterogeneous composition diluted, for example, about 10-fold with water. In embodiments, the intermediate composition can include about 1 to about 50 wt-%, about 3 to about 30 wt-%, or about 5 to about 20 wt-% of the heterogeneous cleaning composition. In an embodiment, the intermediate composition can include about 6, about 7, about 8, about 9, about 10, about 11, about 12, about 13, about 14, about 15, about 16, about 17, about 18, or about 19, in an embodiment about 10 wt-% of the heterogeneous cleaning composition. The composition can include any of these ranges or amounts not modified by about.

In an embodiment, the intermediate composition when kept at ambient conditions for a prolonged period remains suitable for forming a use composition. For example, intermediate composition, once mixed, can remain stable (e.g., does not separate, gel, or precipitate) until use, typically 0.5 to 36 hours, or, in an embodiment, for as long as 14 days. In an embodiment, the present intermediate composition is non-corrosive, non-staining, and/or of low or mild alkalinity.

The intermediate composition can be diluted to form a homogeneous use composition. Typically, a use composition includes about 0.01 to about 1.0 wt-%, about 0.05 to about 0.5 wt-%, or about 0.075 to about 0.3 wt-% of the heterogeneous cleaning composition. The use composition can include about 0.15 wt-%, about 0.09 wt-%, or about 0.11 wt-% of the heterogeneous cleaning composition. The composition can include any of these ranges or amounts not modified by about.

Surfactant

The cleaning agent can be a surfactant or surfactant system. A variety of surfactants can be used in the present heterogeneous cleaning composition, including anionic, nonionic, cationic, and zwitterionic surfactants, which are commercially available. In an embodiment, the surfactant includes a nonionic or anionic surfactant. For a discussion of surfactants, see Kirk-Othmer, *Encyclopedia of Chemical Technology*, Third Edition, volume 8, pages 900-912.

In an embodiment, the present heterogeneous composition includes surfactant at about 0.1 to about 75 wt-%, about 3 to about 75 wt-%, about 5 to about 75 wt-%, about 10 to about 60 wt-%, about 20 to about 40 wt-%, about 25 to about 50 wt-%, or about 30 to about 50 wt-%. In an embodiment, the present heterogeneous composition includes surfactant at about 25, about 30, about 35, about 40, or about 45 wt-%, at about 30 wt-%, or at about 40 wt-%. The composition can include any of these ranges or amounts not modified by about. Typically, the cleaning composition includes surfactant in an amount effective to provide a desired level of cleaning, a homogeneous intermediate composition, and a heterogeneous cleaning composition.

Nonionic surfactants useful in the present heterogeneous cleaning compositions, include those having a polyalkylene oxide polymer as a portion of the surfactant molecule. These surfactants can be capped or uncapped. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, fatty alcohol ethoxylates (e.g., tridecyl alcohol alkoxylate, ethylene oxide adduct), and the like; nonylphenol ethoxylate, polyoxyethylene glycol ethers, and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC (BASF-Wyandotte), and the like; ethoxylated amines and ether amines commercially available from Tomah Corporation and other like nonionic compounds. Silicone surfactants such as the ABIL B8852 (Goldschmidt) can also be used.

Preferred nonionic surfactants include linear and secondary alcohol ethoxylates (fatty alcohol ethoxylates, e.g., tridecyl alcohol alkoxylate, ethylene oxide adduct), alkyl phenol ethoxylates, ethoxy/propoxy block surfactants, and the like. Examples of preferred linear and secondary alcohol ethoxylates (fatty alcohol ethoxylates, e.g., tridecyl alcohol alkoxylate, ethylene oxide adduct) include five mole ethoxylate of linear, primary 12-14 carbon number alcohol $(C_{12\text{-}14}H_{25\text{-}29})$—O—$(CH_2CH_2O)_5H$ (one of which is sold under the tradename LAE 24-5), seven mole ethoxylate of linear, primary 12-14 carbon number alcohol $(C_{12\text{-}14}H_{25\text{-}29})$—O—$(CH_2CH_2O)_7H$ (one of which is sold under the tradename LAE 24-7), twelve mole ethoxylate of linear, primary 12-14 carbon number alcohol $(C_{12\text{-}14}H_{25\text{-}29})$—O—$(CH_2CH_2O)_{12}H$ (one of which is sold under the tradename LAE 24-12), and the like.

In an embodiment, the nonionic surfactant is present at about 5 to about 75 wt-%, about 10 to about 60 wt-%, about 20 to about 40 wt-%, or about 30 to about 50 wt-%. In an embodiment, the nonionic surfactant is present at surfactant at about 25, about 30, about 35, about 40, or about 45 wt-%, at about 30 wt-%, or at about 40 wt-%. The composition can include any of these ranges or amounts not modified by about.

Anionic surfactants useful in the present heterogeneous cleaning compositions, include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates (e.g., linear dodecyl benzene sulfonic acid or salts thereof), alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, ethoxylated alcohol phosphate esters, and the like. Preferred anionics include sodium alkylarylsulfonate, alkylbenzenesulfonates (e.g., linear dodecyl benzene sulfonic acid or salts thereof), and the like.

Surface active substances are classified as cationic if the charge on the hydrophilic portion of the molecule is positive. Surfactants in which the hydrophile carries no charge unless the pH is lowered close to neutrality or lower, but which are then cationic (e.g. alkyl amines), are also included in this group.

Cationic surfactants can include compounds containing at least one long carbon chain hydrophobic group and at least one positively charged nitrogen. The long carbon chain group may be attached directly to the nitrogen atom by simple substitution; or indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The majority of large volume commercial cationic surfactants can be subdivided into four major classes and additional sub-groups, for example, as described in "Surfactant Encyclopedia", *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, dialkylammonium salts, and the like. Cationic surfactants are known to have a variety of properties that can be beneficial in the present compositions. These desirable properties can include detergency, antimicrobial efficacy, and the like.

Sequestrant

The present heterogeneous cleaning composition can include a sequestrant. In general, a sequestrant is a molecule capable of coordinating (i.e., binding) the metal ions commonly found in natural water to prevent the metal ions from interfering with the action of the other detersive ingredients of a cleaning composition. Some chelating/sequestering agents can also function as a threshold agent when included in an effective amount. For a further discussion of chelating agents/sequestrants, see Kirk-Othmer, *Encyclopedia of Chemical Technology*, Third Edition, volume 5, pages 339-366 and volume 23, pages 319-320.

A variety of sequestrants can be used in the present heterogeneous cleaning composition, including, for example, organic phosphonate, aminocarboxylic acid, condensed phosphate, inorganic builder, polymeric polycarboxylate, di- or tricarboxylic acid, mixture thereof, or the like. Such sequestrants and builders are commercially available. In an embodiment, the present heterogeneous cleaning composition includes about 5 to about 50 wt-%, about 30 to about 50 wt-%, about 10 to about 45 wt-%, or about 20 to about 40 wt-% sequestrant. In an embodiment, the present heterogeneous cleaning composition includes about 20 wt-%, about 25 wt-%, about 30 wt-%, about 35 wt-%, or about 40 wt-% sequestrant. The composition can include any of these ranges or amounts not modified by about.

Suitable condensed phosphates include sodium and potassium orthophosphate, sodium and potassium pyrophosphate, sodium and potassium tripolyphosphate, sodium hexametaphosphate, for example, tripolyphosphate. In an embodiment, the present heterogeneous cleaning composition includes as a builder, chelator, or sequestrant a condensed phosphate, such as sodium tripolyphosphate.

Polycarboxylates suitable for use as sequestrants include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, polymaleic acid, polyfumaric acid, copolymers of acrylic and itaconic acid, and the like. In an embodiment, the polycarboxylate includes polyacrylate.

Suitable di- or tricarboxylic acids include oxalic acid, citric acid, or salts thereof. In an embodiment, oxalic acid can be employed for reducing levels of iron in the use composition or removing iron soil from the article being cleaned. For example, oxalic acid can be part of an iron control sour or iron remover.

In an embodiment, the present heterogeneous cleaning composition includes as sequestrant or builder condensed phosphate and polyacrylate, or another polymer, for example, sodium tripolyphosphate and polyacrylate.

The builder can include an organic phosphonate, such as an organic-phosphonic acid and alkali metal salts thereof. Some examples of suitable organic phosphonates include:

1-hydroxyethane-1,1-diphosphonic acid: $CH_3C(OH)[PO(OH)_2]_2$;

aminotri(methylenephosphonic acid): $N[CH_2PO(OH)_2]_3$;

aminotri(methylenephosphonate), sodium salt

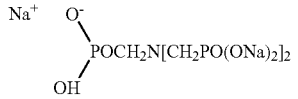

2-hydroxyethyliminobis(methylenephosphonic acid): $HOCH_2CH_2N[CH_2PO(OH)_2]_2$;

diethylenetriaminepenta(methylenephosphonic acid): $(HO)_2POCH_2N[CH_2CH_2N[CH_2PO(OH)_2]_2]_2$;

diethylenetriaminepenta(methylenephosphonate), sodium salt: $C_9H_{(28-x)}N_3Na_xO_{15}P_5$ (x=7);

hexamethylenediamine(tetramethylenephosphonate), potassium salt: $C_{10}H_{(28-x)}N_2K_xO_{12}P_4$ (x=6);

bis(hexamethylene)triamine(pentamethylenephosphonic acid):

$(HO_2)POCH_2N[(CH_2)_6N[CH_2PO(OH)_2]_2]_2$; and phosphorus acid $H_3PO_3$; and other similar organic phosphonates, and mixtures thereof.

The sequestrant can be or include aminocarboxylic acid type sequestrant. Suitable aminocarboxylic acid type sequestrants include the acids or alkali metal salts thereof, e.g., amino acetates and salts thereof. Some examples include the following:

N-hydroxyethylaminodiacetic acid;

hydroxyethylenediaminetetraacetic acid, nitrilotriacetic acid (NTA);

methylglycinediacetic acid (MGDA);

ethylenediaminetetraacetic acid (EDTA);

N-hydroxyethyl-ethylenediaminetriacetic acid (HEDTA);

diethylenetriaminepentaacetic acid (DTPA); and alanine-N,N-diacetic acid;

and the like; and mixtures thereof.

In an embodiment, the aminocarboxylate includes the sodium salt of EDTA.

Source of Alkalinity

The present heterogeneous cleaning composition can include effective amounts of one or more alkalinity sources to enhance cleaning of a substrate and improve soil removal performance of the composition. The source of alkalinity can include an alkali metal salt, such as alkali metal carbonate, alkali metal hydroxide, alkali metal silicate (e.g., metasilicate), or the like; metal borate, such as sodium or potassium borate, and the like; ethanolamines and amines; and other like alkaline sources. Typically the quantity of alkalinity source is sufficient to render the composition mildly alkaline. In an embodiment, the source of alkalinity includes carbonate salts, such as sodium carbonate.

Examples of useful alkaline metal silicates include sodium or potassium silicate (with a $M_2O:SiO_2$ ratio of 1:2.4 to 5:1, M representing an alkali metal) or metasilicate. In an embodiment, the alkaline metal silicates include sodium metasilicate.

In an embodiment, the present heterogeneous cleaning composition includes about 0 to about 50 wt-%, about 1 to about 40 wt-%, about 2 to about 50 wt-%, about 3 to about 50 wt-%, about 3 to about 30 wt-%, about 5 to about 40 wt-%, about 5 to about 20 wt-%, about 10 to about 30 wt-%, or about 15 to about 25 wt-% source of alkalinity. In an embodiment, the present heterogeneous cleaning composition can include about 5 wt-%, about 10 wt-%, about 15 wt-%, about 20 wt-%, or about 25 wt-% source of alkalinity. The composition can include any of these ranges or amounts not modified by about.

Enzyme and Active Enzyme Composition

The present homogeneous cleaning compositions can include a detersive enzyme or an active enzyme composition. As used herein, the phrase active enzyme composition refers to detersive enzyme plus components that maintain the enzyme in its active form during storage and in the heterogeneous cleaning composition and in the intermediate homogeneous composition. For example, an active enzyme composition can include detersive enzyme, polyol, boric acid salt, and calcium salt. The active enzyme composition can include a composition described in pending U.S. patent application Ser. No. 10/208,404 filed Jul. 29, 2002, the disclosure of which is incorporated herein by reference.

Certain of the enzyme activity maintenance components may be of a category that, in large amounts, may work to promote homogeneity of the components of the heterogeneous cleaning composition. When used as part of the active enzyme composition, any such component is used at a level that does not make the heterogeneous cleaning composition homogeneous. Even with such components at concentrations that keep the enzyme active in the cleaning composition, the heterogeneous cleaning composition remains heterogeneous. For example, a polyol at concentrations of 10 to 30 wt-% can act as a hydrotrope and promote homogeneity. An enzyme stabilizing polyol is typically employed at about 5 wt-%, and at such a concentration the heterogeneous composition remains heterogeneous.

Activity Maintenance Components

The heterogeneous cleaning composition can include a variety of ingredients suitable to keep the enzyme active in the heterogeneous cleaning composition. Suitable activity maintenance components include polyol, boric acid salt, and calcium salt.

In an embodiment, the boric acid salt is potassium borate or monoethanolamine borate. The boric acid salt, e.g. potassium or monoethanolamine borate, can be obtained by any of a variety of routes. For example, commercially available boric acid salt, e.g. potassium borate, can be added to the composition. Alternatively, the boric acid salt, e.g. potassium or monoethanolamine borate, can be obtained by neutralizing boric acid with a base, e.g. a potassium containing base such as potassium hydroxide or a base such as monoethanolamine.

Suitable boric acid salts provide alkalinity to the stabilized enzyme cleaning solution. Such salts include certain alkali metal boric acid salts; amine boric acid salts, in an embodiment alkanolamine boric acid salts; and the like; or a combination thereof. In an embodiment, the boric acid salts include potassium borate, monoethanolammonium borate, diethanolammonium borate, triethanolammonium borate, and the like, or a combination thereof.

Suitable activity maintenance components include polyol. The polyol advantageously provides additional stability properties to the stabilized enzyme cleaning composition. In an embodiment, the polyol includes propylene glycol or sorbitol.

Suitable activity maintenance components include a water-soluble source of calcium and/or magnesium ions. Calcium ions are generally more effective than magnesium ions and can be employed if only one type of cation is being used. Typical cleaning and/or heterogeneous cleaning compositions, especially liquids, will include from about 1 to about 30, from about 2 to about 20, or from about 8 to about 12 millimoles of calcium ion per liter of finished composition, though variation is possible depending on factors including the multiplicity, type and levels of enzymes incorporated. In an embodiment, water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the listed calcium salts may be used. Further increased levels of calcium and/or magnesium may of course be useful, for example for promoting the grease-cutting action of certain types of surfactant.

In an embodiment, the active enzyme composition includes enzyme, polyol, alkanolamine, boric acid, and/or source of calcium ions. In an embodiment, the enzyme includes protease. In an embodiment, the polyol includes propylene glycol. In an embodiment, the alkanolamine includes ethanol amine, such as monoethanolamine. In an embodiment, the boric acid includes a boric acid salt, such as monoethanolamine borate. In an embodiment, the source of calcium ions includes calcium chloride. In an embodiment, the active enzyme composition includes enzyme, polyol, alkanolamine, boric acid, and source of calcium ions.

In an embodiment, the active enzyme composition includes protease, propylene glycol, monoethanolamine borate, and calcium chloride. A heterogeneous cleaning composition including such an active enzyme composition can include: about 2 to about 6 wt-%, about 3 to about 5 wt-%, or about 4 (e.g., 3.75) wt-% propylene glycol; about 5 to about 15 wt-%, about 8 to about 12 wt-%, or about 10 wt-% monoethanolamine borate; about 0.1 to about 0.4 wt-%, about 0.2 to about 0.3 wt-% calcium chloride; and/or about 0.25 wt-% calcium chloride. The composition can include any of these ranges or amounts not modified by about.

Enzymes

The present heterogeneous cleaning composition of the present invention can include one or more enzymes, which can provide desirable activity for removal of protein-based, carbohydrate-based, or triglyceride-based stains from substrates. Although not limiting to the present invention, enzymes suitable for the heterogeneous cleaning compositions can act by degrading or altering one or more types of soil residues encountered on a surface or textile thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes include a protease, an amylase, a lipase, a gluconase, a cellulase, a peroxidase, or a mixture thereof of any suitable origin, such as vegetable, animal, bacterial, fungal or yeast origin. Selections can be influenced by factors such as pH-activity and/or stability optima, thermostability, and stability to active detergents, builders and the like. In this respect bacterial or fungal enzymes are preferred, such as bacterial amylases and proteases, and fungal cellulases. In an embodiment, the enzyme is a protease, a lipase, an amylase, or a combination thereof.

"Detersive enzyme", as used herein, means an enzyme having a cleaning, destaining or otherwise beneficial effect as a component of a heterogeneous cleaning composition for laundry, textiles, warewashing, or the like. Preferred detersive enzymes include a hydrolase such as a protease, an amylase, a lipase, or a combination thereof. Enzymes are normally incorporated into a heterogeneous cleaning composition according to the invention in an amount sufficient to yield effective cleaning during a laundry washing or presoaking procedure. An amount effective for cleaning also can refer to an amount that produces a cleaning, stain removal, soil removal, whitening, deodorizing, or freshness improving effect on substrates such as fabrics, and the like. Typically such a cleaning effect can be achieved with amounts of enzyme from about 0.1% to about 3% by weight, or about 1% to about 3% by weight, of the heterogeneous cleaning composition.

Commercial enzymes, such as alkaline proteases, are obtainable in liquid or dried form, are sold as raw aqueous solutions or in assorted purified, processed and compounded forms, and include about 2% to about 80% by weight active enzyme generally in combination with stabilizers, buffers, cofactors, impurities and inert vehicles. The actual active enzyme content depends upon the method of manufacture and is not critical, assuming the heterogeneous cleaning composition has the desired enzymatic activity. The particular enzyme chosen for use in the process and products of this invention depends upon the conditions of final utility, including the physical product form, use pH, use temperature, and soil types to be degraded or altered. The enzyme can be chosen to provide optimum activity and stability for any given set of utility conditions.

In an embodiment, the heterogeneous cleaning compositions of the present invention include at least a protease.

A valuable reference on enzymes is "Industrial Enzymes", Scott, D., in *Kirk-Othmer Encyclopedia of Chemical Technology,* 3rd Edition, (editors Grayson, M. and EcKroth, D.) Vol. 9, pp. 173-224, John Wiley & Sons, New York, 1980.

Protease

A protease suitable for the heterogeneous cleaning composition of the present invention can be derived from a plant, an animal, or a microorganism. In an embodiment, the protease is derived from a microorganism, such as a yeast, a mold, or a bacterium. In an embodiment, proteases include serine proteases active at alkaline pH, for example, derived from a strain of *Bacillus* such as *Bacillus subtilis* or *Bacillus licheniformis*; these proteases include native and recombinant subtilisins. The protease can be purified or a component of a microbial extract, and either wild type or variant (either chemical or recombinant). In an embodiment, the protease is neither inhibited by a metal chelating agent (sequestrant) or a thiol poison nor activated by metal ions or reducing agents, has a broad substrate specificity, is inhibited by diisopropylfluorophosphate (DFP), is an endopeptidase, has a molecular weight in the range of about 20,000 to about 40,000, and is active at a pH of about 6 to about 12 and at temperatures in a range from about 20° C. to about 80° C.

Examples of proteolytic enzymes which can be employed in the heterogeneous cleaning composition of the invention include (with trade names) Savinase®; a protease derived from *Bacillus lentus* type, such as Maxacal®, Opticlean®, Durazym® and Properase®; a protease derived from *Bacillus licheniformis*, such as Alcalase® and Maxatase®; and a protease derived from *Bacillus amyloliquefaciens*, such as Primase®. Commercially available protease enzymes include those sold under the trade names Alcalase®, Savinase®, Primase®, Durazym®, or Esperase® by Novo Industries A/S (Denmark); those sold under the trade names Maxatase®, Maxacal®, or Maxapem® by Gist-Brocades (Netherlands); those sold under the trade names Purafect®, Purafect OX, and Properase by Genencor International; those sold under the trade names Opticlean® or Optimase® by Solvay Enzymes; and the like. A mixture of such proteases can also be used. For example, Purafect® is an alkaline protease (a subtilisin) for use in detergent compositions of this invention having application in lower temperature cleaning programs, from about 30° C. to about 65° C.; whereas, Esperase® is an alkaline protease of choice for higher temperature detersive solutions, from about 50° C. to about 85° C. Suitable detersive proteases are described in patent publications including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. A variant protease employed in the present heterogeneous cleaning compositions can have at least 80% homologous, or at least 80% sequence identity, with the amino acid sequences of the proteases in these references.

In embodiments of this invention, the amount of commercial alkaline protease composite present in the composition of the invention ranges from about 0.1% by weight of detersive solution to about 3% by weight, about 1% to about 3% by weight, or about 2% by weight of solution of the commercial enzyme product. Typical commercially available detersive enzymes include about 5-10% of active enzyme.

Whereas establishing the percentage by weight of commercial alkaline protease required is of practical convenience for manufacturing embodiments of the present teaching, variance in commercial protease concentrates and in-situ environmental additive and negative effects upon protease activity require a more discerning analytical technique for protease assay to quantify enzyme activity and establish correlations to soil residue removal performance and to enzyme stability within the embodiment; and, if a concentrate, to use-dilution solutions. The activity of the proteases for use in the present invention are readily expressed in terms of activity units—more specifically, Kilo-Novo Protease Units (KNPU) which are azocasein assay activity units well known to the art. A more detailed discussion of the azocasein assay procedure can be found in the publication entitled "The Use of Azoalbumin as a Substrate in the Colorimetric Determination of Peptic and Tryptic Activity", Tomarelli, R. M., Charney, J., and Harding, M. L., *J. Lab. Clin. Chem.* 34, 428 (1949).

In certain embodiments of the present invention, the activity of proteases present in the use-solution ranges from about $1\times10^{-5}$ KNPU/gm solution to about $4\times10^{-3}$ KNPU/gm solution.

Naturally, mixtures of different proteolytic enzymes may be incorporated into this invention. While various specific enzymes have been described above, it is to be understood that any protease which can confer the desired proteolytic activity to the composition may be used and this embodiment of this invention is not limited in any way by specific choice of proteolytic enzyme.

Amylase

An amylase suitable for the heterogeneous cleaning composition of the present invention can be derived from a plant, an animal, or a microorganism. In an embodiment, the amylase is derived from a microorganism, such as a yeast, a mold, or a bacterium. In an embodiment, the amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant), in an embodiment, a variant that is more stable under washing or presoak conditions than a wild type amylase.

Examples of amylase enzymes that can be employed in the heterogeneous cleaning composition of the invention include those sold under the trade name Rapidase by Gist-Brocades® (Netherlands); those sold under the trade names Termamyl®, Fungamyl® or Duramyl® by Novo; Purastar STL or Purastar OXAM by Genencor; and the like. Commercially available amylase enzymes include the stability enhanced variant amylase sold under the trade name Duramyl® by Novo. A mixture of amylases can also be used.

Amylases suitable for the heterogeneous cleaning compositions of the present invention include: α-amylases described in WO 95/26397, PCT/DK96/00056, and GB 1,296,839 to Novo; and stability enhanced amylases described in J. Biol. Chem., 260(11):6518-6521 (1985); WO 9510603 A, WO 9509909 A and WO 9402597 to Novo; references disclosed in WO 9402597; and WO 9418314 to Genencor International. A variant α-amylase employed in the present heterogeneous cleaning compositions is at least 80% homologous, or has at least 80% sequence identity, with the amino acid sequences of the proteins of these references.

In an embodiment, amylases for use in the heterogeneous cleaning compositions of the present invention have enhanced stability compared to certain amylases, such as Termamyl®. Enhanced stability refers to a significant or measurable improvement in one or more of: oxidative stability, e.g., to hydrogen peroxide/tetraacetylethylenediamine in buffered solution at pH 9-10; thermal stability, e.g., at common wash temperatures such as about 60° C.; and/or alkaline stability, e.g., at a pH from about 8 to about 11; each compared to a suitable control amylase, such as Termamyl®. Stability can be measured by methods known to those of skill in the art. In an embodiment, enhanced stability amylases for use in the heterogeneous cleaning compositions of the present invention have a specific activity at least 25% higher than the specific activity of Termamyl® at a temperature in a range of 25° C. to 55° C. and at a pH in a range of about 8 to about 10. Amylase activity for such comparisons can be measured by assays known to those of skill in the art and/or commercially available, such as the Phadebas® α-amylase assay.

In certain embodiments of this invention, the amount of commercial amylase present in the composition of the invention ranges from about 0.1% by weight of detersive solution to about 3% by weight, about 1% to about 3% by weight, or about 2% by weight of solution of the commercial enzyme product. Typical commercially available detersive enzymes include about 0.25-5% of active amylase.

Whereas establishing the percentage by weight of amylase required is of practical convenience for manufacturing embodiments of the present teaching, variance in commercial amylase concentrates and in-situ environmental additive and negative effects upon amylase activity may require a more discerning analytical technique for amylase assay to quantify enzyme activity and establish correlations to soil residue removal performance and to enzyme stability within the embodiment; and, if a concentrate, to use-dilution solutions. The activity of the amylases for use in the present invention can be expressed in units known to those of skill or through amylase assays known to those of skill in the art and/or commercially available, such as the Phadebas® α-amylase assay.

Naturally, mixtures of different amylase enzymes can be incorporated into this invention. While various specific enzymes have been described above, it is to be understood that any amylase which can confer the desired amylase activity to the composition can be used and this embodiment of this invention is not limited in any way by specific choice of amylase enzyme.

Cellulases

An cellulase suitable for the heterogeneous cleaning composition of the present invention can be derived from a plant, an animal, or a microorganism. In an embodiment, the cellulase is derived from a microorganism, such as a fungus or a bacterium. Cellulases include those derived from a fungus, such as *Humicola insolens, Humicola* strain DSM1800, or a cellulase 212-producing fungus belonging to the genus *Aeromonas* and those extracted from the hepatopancreas of a marine mollusk, *Dolabella Auricula Solander*. The cellulase can be purified or a component of an extract, and either wild type or variant (either chemical or recombinant).

Examples of cellulase enzymes that can be employed in the heterogeneous cleaning composition of the invention include those sold under the trade names Carezyme® or Celluzyme® by Novo, or Cellulase by Genencor; and the like. A mixture of cellulases can also be used. Suitable cellulases are described in patent documents including: U.S. Pat. No. 4,435,307, GB- A-2.075.028, GB-A-2.095.275, DE-OS-2.247.832, WO 9117243, and WO 9414951 A (stabilized cellulases) to Novo.

In certain embodiments of this invention, the amount of commercial cellulase present in the composition of the invention ranges from about 0.1% by weight of detersive solution to about 3% by weight or about 1% to about 3% by weight of solution of the commercial enzyme product. Typical commercially available detersive enzymes include about 5-10 percent of active enzyme.

Whereas establishing the percentage by weight of cellulase required is of practical convenience for manufacturing embodiments of the present teaching, variance in commercial cellulase concentrates and in-situ environmental additive and negative effects upon cellulase activity may require a more discerning analytical technique for cellulase assay to quantify enzyme activity and establish correlations to soil residue removal performance and to enzyme stability within the embodiment; and, if a concentrate, to use-dilution solutions. The activity of the cellulases for use in the present invention can be expressed in units known to those of skill or through cellulase assays known to those of skill in the art and/or commercially available.

Naturally, mixtures of different cellulase enzymes can be incorporated into this invention. While various specific enzymes have been described above, it is to be understood that any cellulase which can confer the desired cellulase activity to the composition can be used and this embodiment of this invention is not limited in any way by specific choice of cellulase enzyme.

Lipases

A lipase suitable for the heterogeneous cleaning composition of the present invention can be derived from a plant, an animal, or a microorganism. In an embodiment, the lipase is derived from a microorganism, such as a fungus or a bacterium. In an embodiment, lipases include those derived from a *Pseudomonas*, such as *Pseudomonas stutzeri* ATCC 19.154, or from a *Humicola*, such as *Humicola lanuginosa* (typically produced recombinantly in *Aspergillus oryzae*). The lipase can be purified or a component of an extract, and either wild type or variant (either chemical or recombinant).

Examples of lipase enzymes that can be employed in the heterogeneous cleaning composition of the invention include those sold under the trade names Lipase P "Amano" or "Amano-P" by Amano Pharmaceutical Co. Ltd., Nagoya, Japan or under the trade name Lipolase® by Novo, and the like. Other commercially available lipases that can be employed in the present compositions include Amano-CES, lipases derived from *Chromobacter viscosum*, e.g. *Chromobacter viscosum* var. *lipolyticum* NRRLB 3673 from Toyo Jozo Co., Tagata, Japan; *Chromobacter viscosu* lipases from U.S. Biochemical Corp., U.S.A. and Disoynth Co., and lipases derived from *Pseudomonas gladioli* or from *Humicola lanuginosa*.

An embodiment employs lipase sold under the trade name Lipolase® by Novo. Suitable lipases are described in patent documents including: WO 9414951 A (stabilized lipases) to Novo, WO 9205249, RD 94359044, GB 1,372,034, Japanese Patent Application 53,20487, laid open Feb. 24, 1978 to Amano Pharmaceutical Co. Ltd., and EP 341,947.

In certain embodiments of this invention, the amount of commercial lipase present in the composition of the invention ranges from about 0.1% by weight of detersive solution to about 3% by weight or about 1% to about 3% by weight of solution of the commercial enzyme product. Typical commercially available detersive enzymes include about 5-10 percent of active enzyme.

Whereas establishing the percentage by weight of lipase required is of practical convenience for manufacturing embodiments of the present teaching, variance in commercial lipase concentrates and in-situ environmental additive and negative effects upon lipase activity may require a more discerning analytical technique for lipase assay to quantify enzyme activity and establish correlations to soil residue removal performance and to enzyme stability within the embodiment; and, if a concentrate, to use-dilution solutions. The activity of the lipases for use in the present invention can be expressed in units known to those of skill or through lipase assays known to those of skill in the art and/or commercially available.

Naturally, mixtures of different lipase enzymes can be incorporated into this invention. While various specific enzymes have been described above, it is to be understood that any lipase which can confer the desired lipase activity to the composition can be used and this embodiment of this invention is not limited in any way by specific choice of lipase enzyme.

Additional Enzymes

Additional enzymes suitable for use in the present heterogeneous cleaning compositions include a cutinase, a peroxidase, a gluconase, and the like. Suitable cutinase enzymes are described in WO 8809367 A to Genencor. Known peroxidases include horseradish peroxidase, ligninase, and haloperoxidases such as chloro- or bromo-peroxidase. Peroxidases suitable for heterogeneous cleaning compositions are disclosed in WO 89099813 A and WO 8909813 A to Novo. Peroxidase enzymes can be used in combination with oxygen sources, e.g., percarbonate, perborate, hydrogen peroxide, and the like. Additional enzymes suitable for incorporation into the present heterogeneous cleaning composition are disclosed in WO 9307263 A and WO 9307260 A to Genencor International, WO 8908694 A to Novo, and U.S. Pat. No. 3,553,139 to McCarty et al., U.S. Pat. No. 4,101,457 to Place et al., U.S. Pat. No. 4,507,219 to Hughes and U.S. Pat. No. 4,261,868 to Hora et al.

An additional enzyme, such as a cutinase or peroxidase, suitable for the heterogeneous cleaning composition of the present invention can be derived from a plant, an animal, or a microorganism. In an embodiment, the enzyme is derived from a microorganism. The enzyme can be purified or a component of an extract, and either wild type or variant (either chemical or recombinant). In certain embodiments of this invention, the amount of commercial additional enzyme, such as a cutinase or peroxidase, present in the composition of the invention ranges from about 0.1% by weight of detersive solution to about 3% by weight or about 1% to about 3% by weight of solution of the commercial enzyme product. Typical commercially available detersive enzymes include about 5-10 percent of active enzyme.

Whereas establishing the percentage by weight of additional enzyme, such as a cutinase or peroxidase, required is of practical convenience for manufacturing embodiments of the present teaching, variance in commercial additional enzyme concentrates and in-situ environmental additive and negative effects upon their activity may require a more discerning analytical technique for the enzyme assay to quantify enzyme activity and establish correlations to soil residue removal performance and to enzyme stability within the embodiment; and, if a concentrate, to use-dilution solutions. The activity of the additional enzyme, such as a cutinase or peroxidase, for use in the present invention can be expressed in units known to those of skill or through assays known to those of skill in the art and/or commercially available.

Naturally, mixtures of different additional enzymes can be incorporated into this invention. While various specific enzymes have been described above, it is to be understood that any additional enzyme which can confer the desired enzyme activity to the composition can be used and this embodiment of this invention is not limited in any way by specific choice of enzyme.

Bleaching Agent

The present cleaning composition can include a known bleaching agent, such as an active halogen or active oxygen compound. The heterogeneous cleaning composition can include about 3 to about 50 wt-%, about 4 to about 30 wt-%, or about 5 to about 20 wt-% bleaching agent. The heterogeneous cleaning composition can include about 5 wt-%, about 10 wt-%, or about 15 wt-% bleaching agent. The composition can include any of these ranges or amounts not modified by about.

Active Oxygen Compound

The active oxygen compound acts to provide a source of active oxygen and stain bleaching and can also provide antimicrobial action. The active oxygen compound can be inorganic or organic, and can be a mixture thereof. Some examples of active oxygen compound include peroxygen compounds, and peroxygen compound adducts.

Many active oxygen compounds are peroxygen compounds. Any peroxygen compound generally known, and that, in an embodiment, can provide antimicrobial action, can be used. Examples of suitable peroxygen compounds include inorganic and organic peroxygen compounds, or mixtures thereof.

Inorganic Active Oxygen Compounds

Examples of inorganic active oxygen compounds include the following types of compounds or sources of these compounds, or alkali metal salts including these types of compounds, or forming an adduct therewith:

hydrogen peroxide;

group 1 (IA) active oxygen compounds, for example lithium peroxide, sodium peroxide, and the like;

group 2 (IIA) active oxygen compounds, for example magnesium peroxide, calcium peroxide, strontium peroxide, barium peroxide, and the like;

group 12 (IIB) active oxygen compounds, for example zinc peroxide, and the like;

group 13 (IIIA) active oxygen compounds, for example boron compounds, such as perborates, for example sodium perborate hexahydrate of the formula $Na_2[Br_2(O_2)_2(OH)_4]\cdot 6H_2O$ (also called sodium perborate tetrahydrate and formerly written as $NaBO_3\cdot 4H_2O$); sodium peroxyborate tetrahydrate of the formula $Na_2Br_2(O_2)_2[(OH)_4]\cdot 4H_2O$ (also called sodium perborate trihydrate, and formerly written as $NaBO_3\cdot 3H_2O$); sodium peroxyborate of the formula $Na_2[B_2(O_2)_2(OH)_4]$ (also called sodium perborate monohydrate and formerly written as $NaBO_3\cdot H_2O$); and the like; in an embodiment, perborate;

group 14 (IVA) active oxygen compounds, for example persilicates and peroxycarbonates, which are also called percarbonates, such as persilicates or peroxycarbonates of alkali metals; and the like; in an embodiment, percarbonate;

group 15 (VA) active oxygen compounds, for example peroxynitrous acid and its salts; peroxyphosphoric acids and their salts, for example, perphosphates; and the like; in an embodiment, perphosphate;

group 16 (VIA) active oxygen compounds, for example peroxysulfuric acids and their salts, such as peroxymonosulfuric and peroxydisulfuric acids, and their salts, such as persulfates, for example, sodium persulfate; and the like; in an embodiment, persulfate;

group VIIa active oxygen compounds such as sodium periodate, potassium perchlorate and the like.

Other active inorganic oxygen compounds can include transition metal peroxides; and other such peroxygen compounds, and mixtures thereof.

In an embodiment, the compositions and methods of the present invention employ certain of the inorganic active oxygen compounds listed above. In an embodiment, inorganic active oxygen compounds include hydrogen peroxide, hydrogen peroxide adduct, group IIIA active oxygen compound group, VIA active oxygen compound, group VA active oxygen compound, group VIIA active oxygen compound, or mixtures thereof. Examples of such inorganic active oxygen compounds include percarbonate, perborate, persulfate, perphosphate, persilicate, or mixtures thereof. Hydrogen peroxide presents one example of an inorganic active oxygen compound. Hydrogen peroxide can be formulated as a mixture of hydrogen peroxide and water, e.g., as liquid hydrogen peroxide in an aqueous solution. The mixture of solution can include about 5 to about 40 wt-% hydrogen peroxide or 5 to 50 wt-% hydrogen peroxide.

In an embodiment, the inorganic active oxygen compounds include hydrogen peroxide adduct. For example, the inorganic active oxygen compounds can include hydrogen peroxide, hydrogen peroxide adduct, or mixtures thereof. Any of a variety of hydrogen peroxide adducts are suitable for use in the present compositions and methods. For example, suitable hydrogen peroxide adducts include alkali metal percarbonate salt, urea peroxide, peracetyl borate, an adduct of $H_2O_2$ and polyvinyl pyrrolidone, sodium percarbonate, potassium percarbonate, mixtures thereof, or the like. In an embodiment, hydrogen peroxide adducts include percarbonate salt, urea peroxide, peracetyl borate, an adduct of $H_2O_2$ and polyvinyl pyrrolidone, or mixtures thereof. Such hydrogen peroxide adducts include sodium percarbonate, potassium percarbonate, or mixtures thereof, in an embodiment, sodium percarbonate.

Active Oxygen Compound Adducts

Active oxygen compound adducts include any generally known, and that, in an embodiment, can function as a source of active oxygen and as part of the stabilized composition. In an embodiment, the active oxygen adduct includes one or more hydrogen peroxide adducts or peroxyhydrates. Some examples of active oxygen compound adducts include the following:

alkali metal percarbonates, for example sodium percarbonate (sodium carbonate peroxyhydrate), potassium percarbonate, rubidium percarbonate, cesium percarbonate, and the like; ammonium carbonate peroxyhydrate, and the like; urea peroxyhydrate, peroxyacetyl borate; an adduct of $H_2O_2$ polyvinyl pyrrolidone, and the like, and mixtures of any of the above.

In an embodiment, the active oxygen compound includes one or more alkali metal percarbonates, for example, sodium percarbonate.

Organic Active Oxygen Compounds

Any of a variety of organic active oxygen compounds can be employed in the compositions and methods of the present invention. For example, the organic active oxygen compound can be a peroxycarboxylic acid, such as a mono- or di-peroxycarboxylic acid or an ester peroxycarboxylic acid, an alkali metal salt including these types of compounds, or an adduct of such a compound. In an embodiment, the peroxycarboxylic acid includes $C_1$-$C_{24}$ peroxycarboxylic acid, salt of $C_1$-$C_{24}$ peroxycarboxylic acid, ester of $C_1$-$C_{24}$ peroxycarboxylic acid, diperoxycarboxylic acid, salt of diperoxycarboxylic acid, ester of diperoxycarboxylic acid, or mixtures thereof.

In an embodiment, the peroxycarboxylic acid includes $C_1$-$C_{10}$ aliphatic peroxycarboxylic acid, salt of $C_1$-$C_{10}$ aliphatic peroxycarboxylic acid, ester of $C_1$-$C_{10}$ aliphatic peroxycarboxylic acid, or mixtures thereof, for example, salt of or adduct of peroxyacetic acid; in an embodiment, peroxyacetyl borate. In an embodiment, the diperoxycarboxylic acid includes $C_4$-$C_{10}$ aliphatic diperoxycarboxylic acid, salt of $C_4$-$C_{10}$ aliphatic diperoxycarboxylic acid, or ester of $C_4$-$C_{10}$ aliphatic diperoxycarboxylic acid, or mixtures thereof, in an embodiment, a sodium salt of perglutaric acid, of persuccinic acid, of peradipic acid, or mixtures thereof.

Organic active oxygen compounds include other acids including an organic moiety. In an embodiment, the organic active oxygen compound includes perphosphonic acids, perphosphonic acid salts, perphosphonic acid esters, or mixtures or combinations thereof.

Active Halogen Compound

The active halogen compound can, for example, be a source of a free elemental halogen or —OX— wherein X is Cl or Br, under conditions normally used in detergent-bleaching cleaning processes. In an embodiment, the active halogen compound releases chlorine or bromine species. In an embodiment, the active halogen compound releases chlorine.

Chlorine releasing compounds include potassium dichloroisocyanurate, sodium dichloroisocyanurate, chlorinated trisodiumphosphate, calcium hypochlorite, lithium hypochlorite, monochloramine, dichloroamine, [(monotrichloro)-tetra (monopotassium dichloro)]pentaisocyanurate, paratoluene sulfondichloro-amide, trichloromelamine, N-chlorammeline, N-chlorosuccinimide, N,N'-dichloroazodicarbonamide, N-chloro-acetyl-urea, N,N'-dichlorobiuret, chlorinated dicyandiamide, trichlorocyanuric acid, dichloroglycoluril, 1,3-dichloro-5,5-dimethyl hydantoin, 1-3-dichloro-5-ethyl-5-methyl hydantoin, 1-choro-3-bromo-5-ethyl-5-methyl hydantoin, dichlorohydantoin, salts or hydrates thereof, and mixtures thereof. In an embodiment, an organic chlorine releasing compound can be sufficiently soluble in water to have a hydrolysis constant (K) of about $10^{-4}$ or greater.

In an embodiment the bleach is an alkali metal salt of a chloroisocyanurate, a hydrate thereof, or a mixture thereof. Dichloroisocyanurate dihydrate, a chlorine releasing compound, is commercially available from, for example, Monsanto or FMC. This compound can be represented by the formula:

$$NaCl_2C_3N_3O_32H_2O$$

Solvent Cleaning Agent

An optional solvent cleaning agent can impart advantageous grease cutting and cleaning during use of the present heterogeneous cleaning compositions. In an embodiment, the solvent cleaning agent is suitable for removing soils encountered in textile cleaning such as food residues (e.g., tomato sauce, pasta, lard, mayonnaise, potato salad, and the like) or makeup soils (e.g., lipstick, mascara, and the like). The solvent cleaning agent is used at an amount effective for soil (e.g., oily soil) removal in a use composition of the heterogeneous composition. The solvent cleaning agent is kept at a concentration ineffective to render the heterogeneous composition homogeneous.

Suitable solvent cleaning agents include glycol ethers, soybean oil methyl esters, terpenes (e.g., dipentene, D-limonene, or the like), and aliphatic dimethyl esters (dibasic esters), paraffins. Glycol ethers are also known as cellosolves. In an embodiment, the solvent includes or is a soybean methyl ester. Suitable soybean oil methyl esters include those that fall under CAS# 66784-80-9.

In an embodiment, the present heterogeneous cleaning composition includes about 0.1 to about 50 wt-%, about 1 to about 25 wt-%, or about 5 to about 15 wt-% solvent. The composition can include any of these ranges or amounts not modified by about.

Anti-Redeposition Agents

A heterogeneous cleaning composition can include an anti-redeposition agent. A redeposition agent can facilitate sustained suspension of soils in a cleaning solution and prevent the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as carboxymethyl cellulose, hydroxyethyl cellulose, hydroxypropyl cellulose, and the like.

In an embodiment, antiredeposition agents include styrene maleic anhydride copolymers, sodium tripolyphosphate, sodium carboxymethyl cellulose, polyvinylpyrrolidone, acrylic acid polymers.

A heterogeneous cleaning composition can include, for example, about 0.25 to about 5 wt-%, about 0.4 to about 3 wt-%, about 0.5 to about 2 wt-%, or about 0.5 to about 1.5 wt-% antiredeposition agent. In an embodiment, the antiredeposition agent is present at about 1 wt-%. The composition can include any of these ranges or amounts not modified by about.

Optical Brightener

Optical brightener, which can also be referred to as fluorescent whitening agent or fluorescent brightening agent, provides optical compensation for the yellow cast in fabric substrates. With optical brighteners yellowing is replaced by light emitted from optical brighteners present in the area commensurate in scope with yellow color. The violet to blue light supplied by the optical brighteners combines with other light reflected from the location to provide a substantially complete or enhanced bright white appearance. This additional light is produced by the brightener through fluorescence. Optical brighteners can absorb light in the ultraviolet range (e.g., 275-400 nm) and can emit light in the ultraviolet blue spectrum (e.g., 400-500 nm).

Fluorescent compounds belonging to the optical brightener family are typically aromatic or aromatic heterocyclic materials often containing condensed ring system. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.). The choice of optical brighteners for use in detergent compositions will depend upon a number of factors, such as the type of detergent, the nature of other components present in the detergent composition, the temperature of the wash water, the degree of agitation, and the ratio of the material washed to the tub size. The brightener selection is also dependent upon the type of material to be cleaned, e.g., cottons, synthetics, etc. Since most laundry detergent products are used to clean a variety of fabrics, the detergent compositions should contain a mixture of brighteners which are effective for a variety of fabrics. It is of course necessary that the individual components of such a brightener mixture be compatible.

Optical brighteners useful in the present invention are known and commercially available. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene. In an embodiment, optical brighteners include stilbene derivatives.

A heterogeneous cleaning composition can include, for example, about 0 to about 2 wt-%, about 0.05 to about 1 wt-%, about 0.1 to about 0.5 wt-%, or about 0.1 to about 0.2 wt-% optical brightener. In an embodiment, the optical brightener is present at about 0.1 wt-% or at about 0.25 wt-%. The composition can include any of these ranges or amounts not modified by about.

Additives

Heterogeneous cleaning compositions according to the invention can also include additional functional materials or additives that provide a beneficial property, for example, to the composition as manufactured or sold or when dispersed or dissolved in an aqueous solution, e.g., for a particular use. Examples of conventional additives include one or more of each detersive polymer, pH modifier, source of acidity, anticorrosion agent, antimicrobial, aesthetic enhancing agent (i.e., dye, odorant, perfume), lubricant composition, effervescent agent, other such additives or functional ingredients, and the like, and mixtures thereof. Adjuvants and other additive ingredients will vary according to the type of composition being manufactured, and the intended end use of the composition.

Components of Embodiments of Heterogeneous Cleaning Compositions

Some examples of representative constituent concentrations for the present heterogeneous cleaning compositions can be found in Tables 1 and 2, in which the values are given in wt-% of the ingredients in reference to the total composition weight.

TABLE 1

Compositional Ranges for Heterogeneous Cleaning Compositions

| Ingredient | Wt-% | Wt-% | Wt-% | Wt-% |
|---|---|---|---|---|
| Surfactant | 3-75 | 10-60 | 20-40 | 30 |
| Sequestrant | 5-50 | 10-45 | 20-40 | 30 |
| Alkalinity Source | 0-50 | 1-40 | 10-30 | 20 |
| Active Enzyme Composition | 0-30 | 1-30 | 15-25 | 20 |

TABLE 2

Compositional Ranges for Heterogeneous Cleaning Compositions

| Ingredient | Wt-% | Wt-% | Wt-% | Wt-% |
|---|---|---|---|---|
| Nonionic Surfactant | 5-75 | 10-60 | 20-40 | 30 |
| Condensed Phosphate or Organic Chelant | 5-50 | 10-45 | 20-40 | 30 |
| Carbonate Salt | 3-50 | 5-40 | 10-30 | 20 |
| Enzyme | 0-5 | 0.1-4 | 0.5-2 | 1 |
| Enzyme Activity Maintenance | 0-30 | 1-30 | 10-25 | 19 |
| Anti-Redeposition Agent | 0.25-5 | 0.4-3 | 0.5-2 | 1 |
| Optical Brightener | 0-2 | 0.05-1 | 0.1-0.2 | 0.15 |

Certain embodiments include concentrations of representative constituents for the present heterogeneous cleaning compositions found in one or more of Tables 3-5, in which the values are given in wt-% of the ingredients in reference to the total composition weight.

TABLE 3

Compositional Ranges for Heterogeneous Cleaning Compositions

| Ingredient | For Example: | Wt-% | Wt-% | Wt-% | Wt-% |
|---|---|---|---|---|---|
| Surfactant | Nonionic | 5-75 | 10-60 | 30-50 | 40 |
| Sequestrant | Condensed Phosphate | 5-50 | 10-45 | 25-40 | 30 |
| Sequestrant | Organic chelant | 1-30 | 1-20 | 2-10 | 5 |
| Sequestrant | Phosphonate | 0.5-15 | 0.5-6 | 1-4 | 2 |
| Alkalinity | Soda Ash, Silicate | 2-50 | 5-40 | 10-30 | 20 |
| Anti-Redeposition Agent | CMC | 0.25-5 | 0.4-3 | 0.5-2 | 1 |
| Optical Brightener | Stilbene derivative | 0-2 | 0.05-1 | 0.1-0.5 | 0.25 |

TABLE 4

Compositional Ranges for Heterogeneous Cleaning Compositions

| Ingredient | For Example: | Wt-% | Wt-% | Wt-% | Wt-% |
|---|---|---|---|---|---|
| Surfactant | Nonionic | 5-75 | 10-60 | 30-50 | 40 |
| Sequestrant | Condensed Phosphate | 5-50 | 10-45 | 25-40 | 30 |
| Sequestrant | Organic chelant | 1-30 | 1-20 | 2-10 | 4 |
| Sequestrant | Phosphonates | 0.5-15 | 0.5-6 | 1-4 | 3 |
| Alkalinity | Soda Ash, Silicate | 2-50 | 3-30 | 5-20 | 10 |
| Oxygen Bleach | Percarbonate | 3-50 | 4-30 | 5-20 | 10 |
| Anti-Redeposition Agent | CMC | 0.25-5 | 0.4-3 | 0.5-2 | 1 |
| Optical Brightener | Stilbene derivative | 0-2 | 0.05-1 | 0.1-0.5 | 0.25 |

TABLE 5

Compositional Ranges for Heterogeneous Cleaning Compositions

| Ingredient | For Example: | Wt-% | Wt-% | Wt-% | Wt-% |
|---|---|---|---|---|---|
| Surfactant | Nonionic | 5-75 | 10-60 | 30-50 | 30 |
| Sequestrant | Condensed Phosphate | 5-50 | 10-45 | 25-40 | 30 |
| Sequestrant | Organic chelant | 1-30 | 1-20 | 2-10 | 5 |
| Sequestrant | Phosphonate | 0.5-15 | 0.5-6 | 1-4 | 2 |
| Alkalinity | Soda Ash, Silicate | 2-50 | 5-40 | 10-30 | 20 |

TABLE 5-continued

Compositional Ranges for Heterogeneous Cleaning Compositions

| Ingredient | For Example: | Wt-% | Wt-% | Wt-% | Wt-% |
|---|---|---|---|---|---|
| Anti-Redeposition Agent | CMC | 0.25-5 | 0.4-3 | 0.5-2 | 1 |
| Optical Brightener | Stilbene derivative | 0-2 | 0.05-1 | 0.1-0.5 | 0.25 |
| Solvent | Soy methyl ester, terpene | 2-35 | 3-30 | 5-20 | 10 |

Processing and Packaging

In an embodiment, the present composition is made as a homogeneous or as a heterogeneous composition, such as a solution, a powder, a gel, a slurry, or the like. The present cleaning compositions can be made by any of a variety of methods for combining active cleaning ingredients. For example, the various ingredients can be added to a tank and mixed then poured, extruded, blended or by other mechanisms added to a container. Each of the ingredients can even be added separately to the container. In any event, the ingredients, blended or not can be added to a container to provide in the container predetermined or desired amounts of each of the active ingredients. If mixed, the ingredients need form a homogeneous composition and retain its initial physical form only until packaged. After packaging, the present compositions can, for example, separate, precipitate, gel, or solidify in the package.

Certain of the heterogeneous cleaning compositions can be unstable (prone to separate or to not mix) during production. In an embodiment, the present heterogeneous cleaning composition can be formed from one or more premixes that are homogeneous and/or stable. Combined premixes can also be homogeneous and/or stable, or the combined premixes (less than the entire heterogeneous cleaning composition) can be heterogeneous. Processing equipment with apparatus or systems that intermittently or continuously impart mechanical energy on the composition or on components of the composition can keep the composition or components homogeneous in the equipment. For example, composition or components in a tank can be stirred intermittently or continuously. In an embodiment, the processing method employs continuously imparting mechanical energy in those portions of the processing apparatus where this is possible.

In an embodiment, the present heterogeneous cleaning composition can be produced by a method including semi-continuous production in a scraped-wall mixing vessel. In such a method, liquid and/or powder premixes can be fed into a scraped-wall vessel and mixed. Liquid can be pumped and metered into the tank. Powder premix can be fed through a weigh-belt powder feeder. After an appropriate amount of mixing, e.g., suitable to form a pseudo-stable composition that can be packaged to produce packaged compositions of acceptably uniform content, the composition can be packaged. For a continuous or semi-continuous method, feed rates can equal packaging rate, which can maintain tank volume at steady-state. The heterogeneous cleaning composition can be packaged directly from the scraped-wall vessel. This processing method can include recycling product from the packaging line to the tank, which can maintain homogeneity in the event packaging is shut-down for a period of time.

In an embodiment, ingredients can be mixed into a larger, non-scraped-wall, tank from raw material components without premixes. This mixture of raw components can be added into a scraped-wall vessel in its entirety. This embodiment can be advantageous in circumstances in which premixes are not desirable or cannot be formed. In addition, bulk addition of all of the ingredients can avoid errors that might occur in metering ingredients or premixes. However, this embodiment can result in a portion of the composition remaining in the first, non-scraped-wall tank.

In an embodiment, the present heterogeneous cleaning composition can be produced by a method including extruding. For example, premixes or raw materials can be added to an extruder and be conveyed and mixed over the length of the extruder. In an embodiment, the present heterogeneous cleaning compositions can be made with a twin-screw extruder configuration. In an embodiment, the extruder uses mixing elements with some backpressure at the end. A variety of screw configurations and extruder designs can be employed. The present heterogeneous cleaning composition can be packaged directly from the end of the extruder. A two headed filling system can be employed to keep the extruder running continuously. For example, a switch can direct product from one container to the next, providing continuous packaging.

In an embodiment, the present heterogeneous cleaning composition can be produced by a method employing powder blending. Powder blending can employ equipment such as ribbon or ploughshare mixers. These mixers can provide sufficient mechanical energy to blend pseudo-stable and/or high viscosity products to produce the present heterogeneous cleaning composition. Such a method can employ premixes or individual ingredients. The heterogeneous cleaning composition can be packaged directly from the powder blending apparatus. This processing method can include recycling product from the packaging line to the blending apparatus, which can maintain homogeneity in the event packaging is shut-down for a period of time.

In an embodiment, the present heterogeneous cleaning composition can be produced by a method including two stream filling. Such a method can employ stable liquid and/or powder premixes. The premixes can be added into the package in any of a variety of configurations and orders, layers, for example. Layers can be laid down as liquid then powder, powder then liquid, powder and liquid simultaneously, many small layers, or the like. Advantageously, two stream filling can avoid the complication of maintaining pseudo-homogeneity within processing equipment. In this embodiment, quality control testing can be based on testing of the stable premixes and determination mass balance to ensure the proper amount of each ingredient has been added.

Testing of the processing method or apparatus, combined premixes, or the heterogeneous cleaning composition can be conducted, for example, to assess quality of the process or product. Testing can include sampling a premix, combined premix, or the heterogeneous cleaning composition. Samples of heterogeneous premixes, combined premixes or compositions can be accomplished from a mixture to which mechanical energy is being or has recently been imparted to provide a pseudo-stable or temporarily homogeneous mix or composition. The sample can be diluted to a concentration at which it can be homogeneous and its composition determined.

Packaging

Typically, the present composition is packaged. The packaging receptacle or container may be rigid or flexible, and composed of any material suitable for containing the compositions produced according to the invention, as for example glass, metal, plastic film or sheet, cardboard, cardboard composites, paper, and the like. Advantageously, since the composition is processed at or near ambient temperatures, the temperature of the processed mixture is low enough so that the mixture may be added directly into the container or other packaging system without structurally damaging the material. In an embodiment, packaging used to contain the compositions includes rigid capsules.

The present invention includes packaged heterogeneous cleaning compositions. The present compositions can be packaged in a container for the end user. The package can include a label with directions for use of the heterogeneous cleaning compositions by the end user. For example, the directions can relate to placing the packaged heterogeneous cleaning composition in a dispenser, making an intermediate composition, and/or making a use composition.

Methods of Use

It is contemplated that the cleaning compositions of the invention can be used in a broad variety of institutional hospitality, foodservice, healthcare, and like industries. Some examples include textile or laundry cleaning, and a broad variety of other such applications.

The methods include making from the heterogeneous cleaning composition an intermediate composition and/or a use composition, and applying the use composition to the article to be cleaned. The method can include forming a homogeneous intermediate cleaning composition from the heterogeneous cleaning composition, adding the intermediate composition to a diluent (e.g., water) in the presence of the article to be cleaned, and effectively cleaning immediately upon the adding. That is, effective cleaning need not wait for dissolving of the heterogeneous or intermediate composition.

The method can include forming a homogeneous intermediate cleaning composition from the heterogeneous cleaning composition, adding the intermediate composition to water without adding any other cleaning, bleaching, conditioning or other agents to the water to form a use solution, and effectively cleaning an article with the use solution. That is, the present intermediate composition can be a one-shot cleaning composition. No other cleaning, adjunct, or additive compositions need be used with it.

Performance Evaluation

The soil removal ability of the cleaning composition is determined by washing with artificially soiled fabric swatches. The soiled swatches are purchased from a manufacturer or distributor (e.g. Test Fabrics, Inc., West Pittston, Pa.). Soil types such as olive oil, sebum, makeup, wine are characteristic of natural soils found in laundry applications.

Soiled swatches are washed with the cleaning composition in a device such as a Terg-o-tometer (United States Testing Co., Hoboken, N.J.). The Terg-o-tometer is a laboratory washing device that consists of multiple pots that reside in a single temperature-controlled water bath, with overhead agitators under time and speed control. Wash test parameters include: wash temperature, wash duration, mechanical agitation, dose of cleaning composition, water hardness, wash formula, and cloth/liquor ratio.

After a test run, swatches are rinsed, dried and the reflectance measured on a spectrophotometer, e.g. a HunterLab ColorQuest XE system. The % soil removal (SR) is calculated from the difference between the initial (before washing) lightness (L) value and the final L value (after washing):

$$SR = \left(\frac{L_w - L_{uw}}{L_0 - L_{uw}}\right) \times 100\%$$

where:

$L_w$=lightness of the washed swatch $L_{uw}$=lightness of the soiled, unwashed swatch $L_0$=lightness of the white swatch before soiling The present invention may be better understood with reference to the following examples. These examples are intended to be representative of specific embodiments of the invention, and are not intended as limiting the scope of the invention.

EXAMPLES

Example 1

The Present Heterogeneous Cleaning Compositions Effectively Remove Soil

The following heterogeneous cleaning composition was made and demonstrated to effectively dispense using an inventive apparatus, to form a homogeneous intermediate composition at 10 wt-% concentration, and to provide effective removal of soil from textiles when made into a use composition.

| Ingredient | Wt-% |
|---|---|
| Nonionic Surfactant | 30 |
| Condensed Phosphate | 35 |
| Carbonate Salt | 20 |
| Enzyme | 1 |
| Enzyme Activity Maintenance | 14 |
| Anti-Redeposition Agent | 1 |
| Optical Brightener | 0.15 |

The following wash test parameters were employed:

| Wash Test Parameters | |
|---|---|
| Washing Device | Terg-o-tometer |
| Composition Dose, g/L | 1.5 |
| Temperature, ° F. | 120 |
| Time, min. | 10 |
| Agitation, cpm | 100 |
| Water hardness, ppm as $CaCO_3$ | 100 |
| # Soil Swatches/pot | 7 |

This composition provided effective soil removal:

| Swatch Soil | Swatch Fabric | Swatch Manufacturer | % Soil Removal |
|---|---|---|---|
| Blood/Milk/Carbon Black | Cotton | EMPA | 59 |
| Dirty Motor Oil | Poly/Cotton | Test Fabrics | 23 |
| Dust Sebum | Poly/Cotton | Scientific Services | 88 |
| Olive Oil/Carbon Black | Cotton | EMPA | 58 |
| Mineral Oil/Carbon Black | Cotton | EMPA | 33 |
| Makeup | Cotton | CFT | 65 |
| Wine | Cotton | EMPA | 41 |

EMPA (Swiss Federal Laboratories for Materials Testing and Research)
Test Fabrics Inc., West Pittston, Pennsylvania
Scientific Services Inc., New Jersey
CFT (Center for Testmaterials), The Netherlands Example 2

Producing the Heterogeneous Cleaning Compositions of the Present Invention

The present heterogeneous cleaning compositions were successfully produced employing batch and continuous scraped-wall tank apparatus and by extrusion. The density and viscosity were similar regardless of the method of production of the formula.

An embodiment of the present heterogeneous cleaning composition was produced with Formula A (Table 6). This formula was produced by a batchwise (single tank) process employing a liquid mix tank, a continuous process employing a scraped-wall tank, and by extrusion.

Each of these methods effectively produced heterogeneous cleaning composition (Table 7). For example, in each of the tank production methods, the composition did not separate in the mix tank. The method produced consistent compositions. The method produced an embodiment of the present heterogeneous cleaning composition.

TABLE 6

Formula A Composition

| Raw Material | Wt-% |
|---|---|
| Nonionic Surfactant | 30 |
| Condensed Phosphate | 29 |
| Light Density Soda Ash | 20 |
| Enzyme | 1 |
| Enzyme Activity Maintenance | 19 |
| Anti-Redeposition Agent | 1 |
| Optical Brightener | 0.15 |
| Anti-Foam Agent | 0.1 |
| Total | 100 |

TABLE 7

Formula A Production Results

| | Single Tank | Semi-Continuous | Extrusion |
|---|---|---|---|
| Batch Size (lb) | 50 | 150 | 150 |
| Density (g/ml) | 1.408 | 1.32 | 1.29 |
| Viscosity (cps) | 8900 | 4800 | 5400 |
| Tank Empty? | ½" Remains | none | N/A |
| Separation in Package | skim @ 10 min | 2% @ 2 hrs | 0.5% @ 30 min |

An embodiment of the present heterogeneous cleaning composition was produced with Formula B (Table 8). This formula was produced by a batchwise (single tank) process employing a liquid mix tank, a continuous process employing a scraped-wall tank, and by extrusion.

Each of these methods effectively produced heterogeneous cleaning composition (Table 9). For example, in each of the tank production methods, the composition did not separate in the mix tank. The method produced consistent compositions. The method produced an embodiment of the present heterogeneous cleaning composition.

TABLE 8

Formula B Composition

| Raw Material | Wt-% |
|---|---|
| Nonionic Surfactant | 30 |
| Condensed Phosphate | 29 |
| Grade 100 Soda Ash | 20 |
| Enzyme | 1 |
| Enzyme Activity Maintenance | 19 |
| Anti-Redeposition Agent | 1 |
| Optical Brightener | 0.15 |
| Anti-Foam Agent | 0.1 |
| Total | 100 |

TABLE 9

Formula B Production Results

| | Single Tank | Semi-Continuous | Extrusion |
|---|---|---|---|
| Batch Size (lb) | 50 | 150 | 150 |
| Density (g/ml) | 1.4 | 1.33 | 1.29 |
| Viscosity (cps) | 5160 | 2400 | 2400 |
| Tank Empty? | ½" Remains | 2" Remains | N/A |
| Separation in Package | 2% @ 20 min | 8% @ 2 hrs | 2.5% @ 45 min |

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the term "configured" describes a system, apparatus, or other structure that is constructed or configured to perform a particular task or adopt a particular configuration. The term "configured" can be used interchangeably with other similar phrases such as arranged and adapted and configured, constructed and arranged, constructed, manufactured and arranged, and the like.

The invention has been described with reference to various specific and preferred embodiments and techniques. However, it should be understood that many variations and modifications may be made while remaining within the spirit and scope of the invention.

We claim:

1. A heterogeneous cleaning composition comprising:

(a) more than about 75 wt-% active ingredients, said active ingredients comprising:

(i) at least about 20 wt-% surfactant:

(ii) at least about 20 wt-% sequestrant; and (iii) about 1 wt-% to about 30 wt-% active enzyme composition comprising a detersive enzyme and an activity maintenance component, wherein the composition comprises two or more substances that are not evenly dispersed, the composition comprises at least one liquid and at least one powder, the composition contains no added water beyond any trace or incidental amounts present in the active ingredients, and the composition does not include a dispersant.

2. The composition of claim 1, wherein the composition comprises about 99 wt-% or greater of active ingredients.

3. The composition of claim 1, wherein the composition comprises about 30 wt-% to about 50 wt-% of surfactant and about 30 wt-% to about 50 wt-% sequestrant.

4. The composition of claim 1, wherein the composition further comprises about 10 wt-% to about 30 wt-% of a source of alkalinity, about 0.05 wt-% to about 1 wt-% optical brightener, and about 0.25 wt-% to about 5 wt-% of an antiredeposition agent.

5. The composition of claim 1, wherein the surfactant is a nonionic surfactant selected from the group consisting of linear and secondary alcohol ethoxylates, alkyl phenol ethoxylates, ethoxy/propoxy block surfactants and mixtures thereof.

6. The composition of claim 1, wherein the sequestrant is selected from the group consisting of dicarboxylic acids, tricarboxylic acids, and salts thereof.

7. The composition of claim 1, wherein the composition comprises about 0.1wt-% to about 4.0 wt-% of the detersive enzyme, and about 1wt-% to about 30 wt-% of the activity maintenance component.

8. The composition of claim 1, wherein the detersive enzyme is selected from the group consisting of a protease, an amylase, a lipase, a gluconase, a cellulase, a peroxidase, a cutinase, a peroxidase, and mixtures thereof.

9. The composition of claim 1, wherein the activity maintenance component comprises a polyol.

10. The composition of claim 9, wherein the polyol is selected from the group consisting of propylene glycol and sorbitol.

11. The composition of claim 1, wherein the activity maintenance component comprises a water soluble source of calcium ions.

12. The composition of claim 11, wherein the source of calcium ion is selected from the group consisting of calcium chloride, calcium hydroxide, calcium formate, calcium malate, calcium acetate, calcium sulfate and mixtures thereof.

13. The composition of claim 1, wherein the activity maintenance component comprises a water soluble source of magnesium ions.

14. The composition of claim 13, wherein the source of magnesium ion is selected from the group consisting of magnesium chloride, magnesium hydroxide, magnesium formate, magnesium malate, magnesium acetate, magnesium sulfate and mixtures thereof.

15. The composition of claim 1, wherein the composition is packaged for the end user.

* * * * *